US006408662B1

(12) United States Patent
Sugimoto

(10) Patent No.: US 6,408,662 B1
(45) Date of Patent: Jun. 25, 2002

(54) LOCKING DEVICE WITH KEY-OPERATED LOCK

(75) Inventor: Naoyuki Sugimoto, Tokyo (JP)

(73) Assignee: Takigen MFG. Co., Ltd., Tokyo (JP)

( * ) Notice: Subject to any disclaimer, the term of this patent is extended or adjusted under 35 U.S.C. 154(b) by 0 days.

(21) Appl. No.: 09/620,851

(22) Filed: Jul. 21, 2000

(30) Foreign Application Priority Data

Aug. 2, 1999 (JP) ..... 11-218462

(51) Int. Cl.[7] ..... E05B 29/04; E05B 27/02
(52) U.S. Cl. ..... 70/375; 70/369; 70/371
(58) Field of Search ..... 70/375, 379 R, 70/372, 369, 490, 376, 377, 368, 403, 373, 367, 371, 379 A, 380

(56) References Cited

U.S. PATENT DOCUMENTS

| | | | | | |
|---|---|---|---|---|---|
| 3,367,156 | A | * | 2/1968 | Johnstone | 70/366 |
| 3,789,638 | A | * | 2/1974 | Roberts et al. | 70/366 |
| 3,855,829 | A | * | 12/1974 | Lipschutz | 70/362 |
| 4,008,588 | A | * | 2/1977 | Miller et al. | 70/366 |
| 4,062,211 | A | * | 12/1977 | Miller et al. | 70/366 |
| 4,398,405 | A | * | 8/1983 | Patriquin | 70/369 |
| 4,424,693 | A | * | 1/1984 | Best et al. | 70/369 |
| 4,680,870 | A | * | 7/1987 | McConnell | 33/540 |
| 5,339,663 | A | * | 8/1994 | Doring | 70/379 |

FOREIGN PATENT DOCUMENTS

| | | | |
|---|---|---|---|
| JP | 63-98950 | 6/1988 | E05B/17/14 |
| JP | 63-177568 | 11/1988 | E05B/27/00 |
| JP | 1-130478 | 9/1989 | E05C/3/14 |
| JP | 09/195598 | 7/1997 | E05B/29/02 |
| JP | 10-008787 | 1/1998 | E05B/3/00 |

* cited by examiner

*Primary Examiner*—Tan Nguyen
*Assistant Examiner*—Dalena Tran
(74) *Attorney, Agent, or Firm*—Darby & Darby

(57) ABSTRACT

A locking device with a key-operated lock is disclosed which includes a cylindrical member having a front open end and a rear end, locking means rotatably supported on the rear end of the cylindrical member, the locking means having a locking bar and an engagement member connected with respect to the locking bar, the engagement member being rotatable to turn the locking bar into locking or unlocking position, a key-operated disk tumbler lock, and a cap cylinder casing the disk tumbler lock therein, the cap cylinder with the disk tumbler lock being detachably accommodated in the cylindrical member through the front open end, wherein the cylindrical member has an engagement recess on its inner surface, the cap cylinder has a peripheral surface, and the disk tumbler lock has a lock pin capable of protruding through the peripheral surface and fitting in the engagement recess when the disk tumbler lock is set.

8 Claims, 6 Drawing Sheets

(a)

(b)

LOCKING DEVICE WITH KEY-OPERATED LOCK

FIELD OF THE INVENTION

The present invention relates to a locking device with a key-operated lock, wherein locking means for locking and unlocking a door or the like closure means is operated from within a cylindrical member that detachably receives a cap cylinder.

BACKGROUND ART

Conventional locking devices with a key-operated lock used for locking a door and the like include a handle for unlocking operation having a key-operated lock incorporated therein. For unlocking a door locked with such a locking device, the key-operated lock is first opened with a separate key by inserting the key into the key slot and turning the key in an unlocking direction, and then the handle is turned to unlock the door.

In such conventional locking devices with a key-operated lock, however, the key-operated lock is integrally assembled with the handle, which complicates the inter-relating mechanism between the two parts, causing disadvantages in assembly, maintenance, or inspection of the device. Further, in order to open the door, the handle should be turned with one hand while the key-operated lock should be opened with the other hand. This makes locking and unlocking of the door difficult and tiresome.

SUMMARY OF THE INVENTION

The present invention has been made for overcoming such conventional problems. It is thus an object of the present invention to provide a locking device with a key-operated lock wherein the key-operated lock is provided as a separate part from the main locking mechanism while readiness for assembly, maintenance, and inspection of the parts are preserved.

It is another object of the present invention to provide a locking device with a key-operated lock wherein the structure and operation of the locking mechanism is simplified while the security of the device is improved.

It is yet another object of the present invention to provide a locking device with a key-operated lock of which cost is reduced.

According to the present invention, there is provided a locking device with a key-operated lock comprising:

- a cylindrical member having a front open end and a rear end,
- locking means rotatably supported on said rear end of said cylindrical member, said locking means having a locking bar and an engagement member connected with respect to said locking bar, said engagement member being rotatable to turn said locking bar into locking or unlocking position,
- a key-operated disk tumbler lock, and
- a cap cylinder casing said disk tumbler lock therein, said cap cylinder with said disk tumbler lock being detachably accommodated in the cylindrical member through the front open end,
- wherein said cylindrical member has an engagement recess on its inner surface, said cap cylinder has a peripheral surface, and said disk tumbler lock has a lock pin capable of protruding through said aperture and fitting in said engagement recess when said disk tumbler lock is set.

The above and other objects as well as advantages of the present invention will be further appreciated from the following detailed description of the preferred embodiments of the invention, taken in conjunction with the accompanying drawings.

DETAILED DESCRIPTION OF PREFERRED EMBODIMENTS

Figure 1:
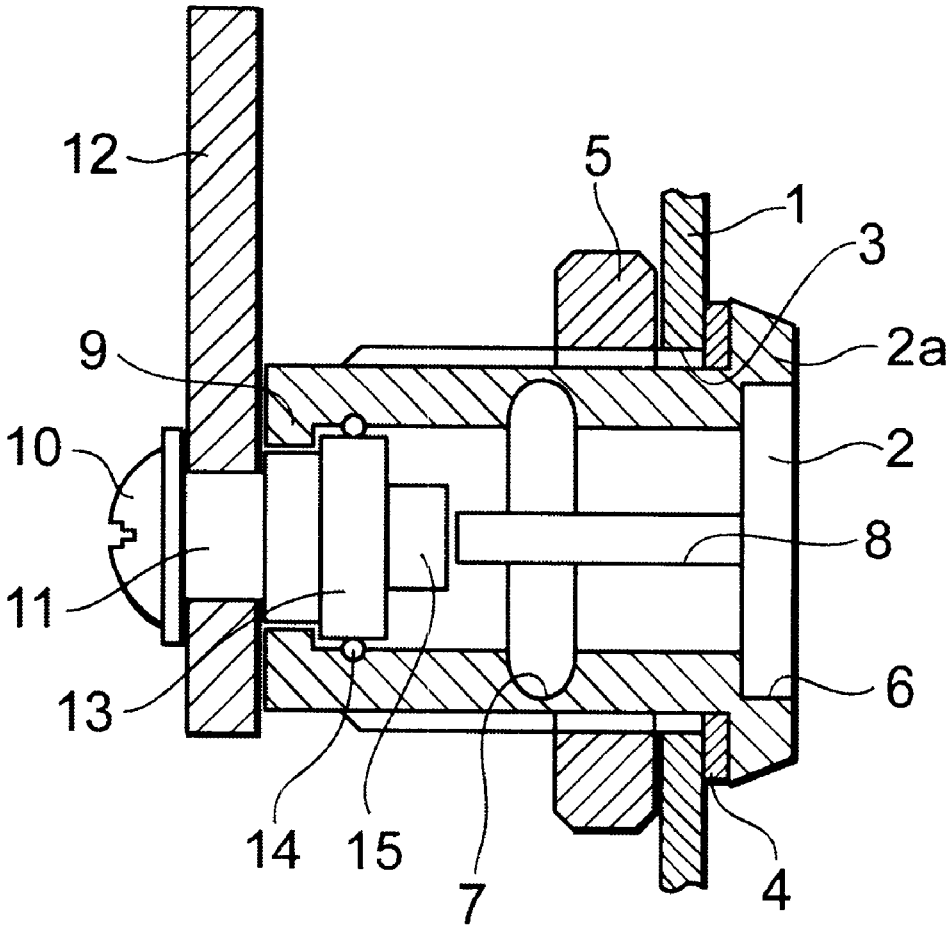
FIG. 1 is a longitudinal sectional view of an embodiment of the cylindrical member and locking means of the locking device according to the present invention.

The locking device with a key-operated lock according to the present invention includes a cylindrical member having a front open end and a rear end, locking means rotatably supported on the rear end of the cylindrical member, a key-operated disk tumbler lock, and a cap cylinder casing the disk tumbler lock therein. The locking means has a locking bar and an engagement member connected with respect to the locking bar. The engagement member is rotatable to turn the locking bar into locking or unlocking position. The cap cylinder with the disk tumbler lock is detachably accommodated in the cylindrical member through the front open end.

The cylindrical member has an engagement recess in the inner surface thereof, the cap cylinder has a peripheral surface, and the disk tumbler lock has a lock pin capable of protruding through the peripheral surface and fitting in the engagement recess when the disk tumbler lock is set.

According to one aspect of the present invention, when the door and the like closure means is locked with the locking bar, that is, when the locking bar is placed in the locking position, the cap cylinder with the disk tumbler lock cased therein is inserted into the cylindrical member through the front open end. The disk tumbler lock is then set to protrude the lock pin through the peripheral surface of the cap cylinder and to fit the pin in the engagement recess of the cylindrical member. Accordingly, the cap cylinder with the disk tumbler lock therein is fixed in the cylindrical member, which blocks the cavity of the cylindrical member, preventing access to the engagement member of the locking means to prevent displacement of the locking bar into the unlocking position.

On the other hand, when the disk tumbler lock is opened to retract the lock pin with respect to the peripheral surface of the cap cylinder, the fixation of the cap cylinder with the disk tumbler lock with respect to the cylindrical member is released, and the cap cylinder with the disk tumbler lock may be extracted from the cylindrical member. This clears the cavity of the cylindrical member, and allows access to the engagement member. Rotation of the engagement member turns the locking bar into the unlocking position, thereby unlocking the door.

The locking device of the present invention may further include a lock operation member capable of engaging with and rotating said engagement member to turn the locking bar into locking or unlocking position, and a key for setting or opening the disk tumbler lock. The key may be made unextractable from the disk tumbler lock when said disk tumbler lock is opened.

According to this embodiment, following the opening of the disk tumbler lock with the key with one hand retracting the lock pin, the cap cylinder with the disk tumbler lock cased therein may readily be extracted from the cylindrical member by pulling the key with the same hand. The key is retained in the disk tumbler lock, so that it may not be lost easily.

The locking device of the present invention may optionally have a seal disposed between the locking means and the inner surface of the cylindrical member. The seal protects the locking means against intrusion of water droplets or dust through the front open end of the cylindrical member, thereby preventing the locking device from corrosion.

The engagement member of the locking means may either be a boss or a recess. When the engagement member is a boss, the lock operation member for engaging with and rotating the engagement member has a complementary recess fitting with the boss. When the engagement member is a recess, the corresponding lock operation member has a complementary boss fitting with the recess.

According to this embodiment, engagement between the engagement member and the lock operation member can be achieved readily and securely via a simple boss-and-recess engagement. Further, even heavily loaded locking means can be displaced into the locking or unlocking position by applying only a small force on the lock operation member.

The engagement recess in the inner surface of the cylindrical member may be an annular groove formed circumferentially along the inner surface.

According to this embodiment, when the disk tumbler lock is set following insertion of the cap cylinder with the disk tumbler lock into the cylindrical member, the lock pin can easily fit in the annular groove of the cylindrical member. Upon insertion, no limitation is imposed on circumferential positioning of the cap cylinder with respect to the cylindrical member, which facilitates placement of the cap cylinder in the cylindrical member.

The cylindrical member may optionally have a guide groove longitudinally extending in the inner surface thereof, and the cap cylinder may optionally have a guide ridge longitudinally extending on the outer surface thereof for fitting in the guide groove.

According to this embodiment, circumferential positioning of the cap cylinder with respect to the cylindrical member is facilitated upon insertion of the cap cylinder into the cylindrical member.

A preferred embodiment of the present invention will now be explained in further detail with reference to attached drawings.

FIG. 1 is a longitudinal cross-sectional view of the locking mechanism of an embodiment of the locking device with a key-operated lock according to the present invention. The device includes a cylindrical member 2 having an internal cavity opened to the front. The cylindrical member 2 is inserted into an aperture provided in closure means 1 such as a door plate to be locked, and mounted therein via a seal 4 at a flange portion 2*a* formed at one end of the cylindrical member 2. On the outer periphery of the cylindrical member 2 is threaded a nut 5 to securely fixing the cylindrical member 2 in the closure means 1 by fastening the nut 5 onto the cylindrical member 2. An annular step 6 is formed on the inner surface of the cylindrical member 2 at the front end thereof, in which step 6 a head portion of a disk tumbler lock is fitted as will be discussed later.

In the inner surface of the cylindrical member 2, an engagement recess, or an annular groove 7 with a semicircular cross section is provided in the longitudinally middle portion of the cylinder 2. The groove 7 receives and engages lock pins of the disk tumbler lock to be described later. The engagement groove may be replaced with engagement recesses as desired. The inner surface of the cylinder 2 is further provided with a pair of guide grooves 8 extending longitudinally and arranged diametrally opposed to each other (FIG. 2) for guiding guide ridges arranged on the outer periphery of a cap cylinder as will be discussed later.

Figure 2:
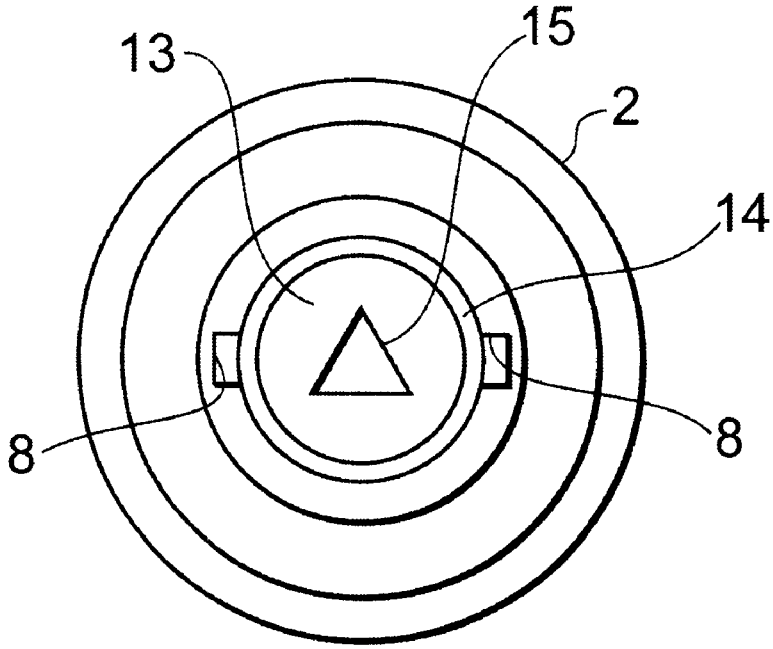
FIG. 2 is a front view of the cylindrical member of FIG. 1.

A bearing portion 9 projecting radially inwardly is formed at the rear end of the cylindrical member 2, which portion 9 rotatably supports a shaft 11 therein. The shaft 11 has a locking bar (latch) 12 affixed thereto with a screw 10. A seal plate 13 in the form of a disk is mounted on the shaft 11, and is provided, in the middle of its front end surface, with an engagement boss 15 in the form of a triangular projection as shown in FIG. 2. The shape of the engagement boss 15 may be other than triangular, that is, for example rectangular, polygonal, or even of complex design. The shaft 11, locking bar 12, screw 10, seal plate 13, and engagement boss 15 together constitute locking means.

When the engagement boss 15 is turned for a predetermined angle as will be discussed later, the locking bar 12 is turned accordingly, and engages with a catch mounted on the other door plate, the door casing, or the like part of the closure means facing to the locking bar 12, to secure the closed state, i.e., to lock the closure means.

A rubber or plastic seal ring (O-ring) 14 is interposed between the outer periphery of the seal plate 14 and the inner surface of the cylindrical member 2 to protect the rear part of the locking means against intrusion of water droplets or dust through the front opening of the cylindrical member 2.

Figure 3:
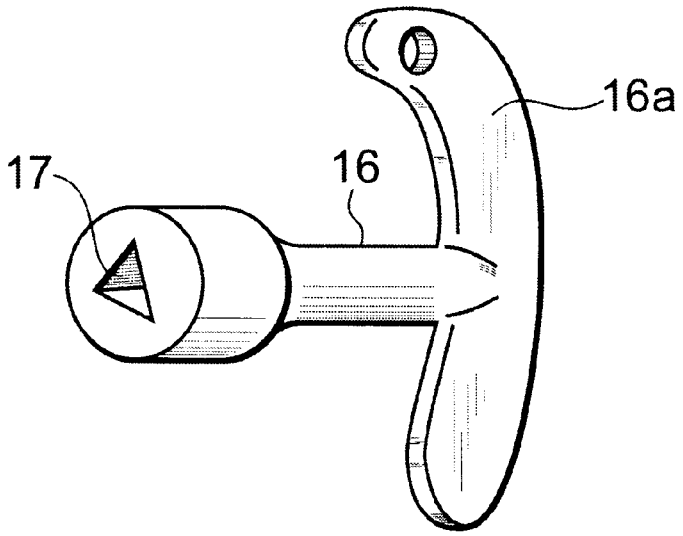
FIG. 3 is a perspective view of the detachable handle according to one aspect of the present invention.

FIG. 3 illustrates a detachable handle 16 acting as a lock operation member in accordance with one aspect of the present invention. The detachable handle 16 has a shaft, a grip 16*a* provided at one end (on the head) of the shaft 16, and an enlarged portion at the other end. On the end surface of the enlarged portion is provided an engagement recess 17 in a triangular form, which detachably fits on the engagement boss 15 on the side of the locking means.

Figure 4:
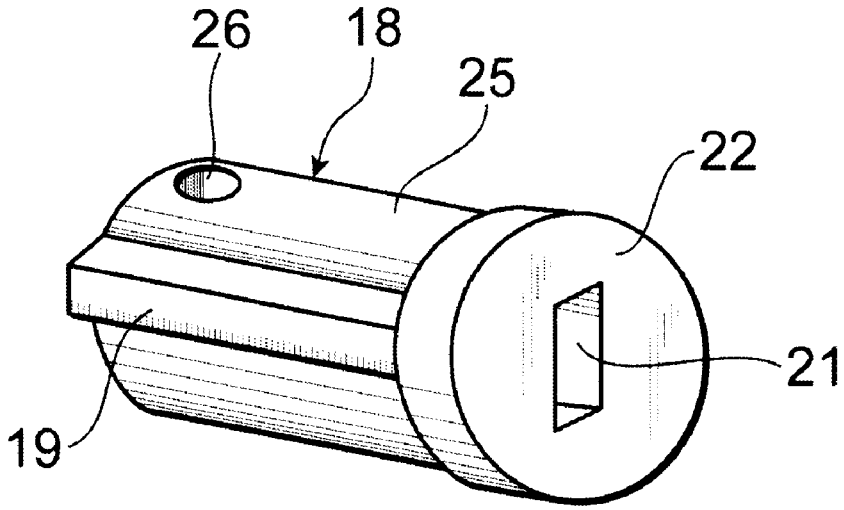
FIG. 4 is a perspective view of the cap cylinder of the present invention.

FIG. 4 is a perspective view of a cap cylinder 18 of the present invention. The cap cylinder 18 has a barrel 25 and a pair of guide ridges 19 on the outer periphery of the barrel arranged diametrally opposite to each other. The guide ridges 19 slidably fit in the guide grooves 8 of the cylindrical member 2 when the cap cylinder is inserted into the cylindrical member 2. The cap cylinder 18 accommodates a disk tumbler lock 20 shown in FIG. 5.

Figure 5:
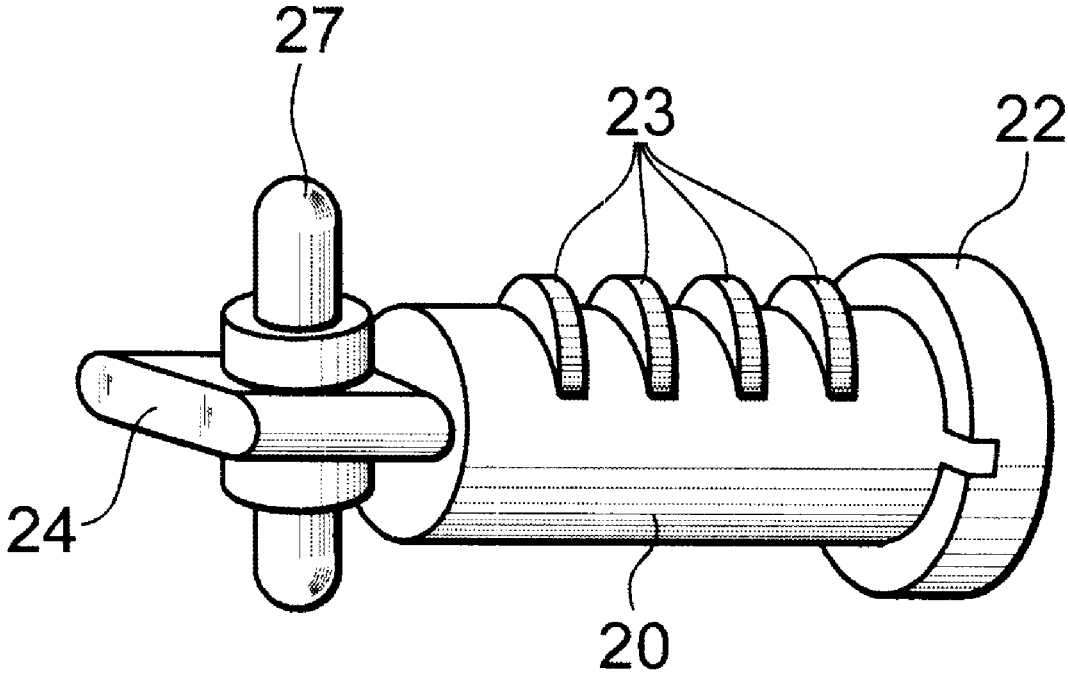
FIG. 5 is a perspective view of the disk tumbler lock of the present invention.

Referring to FIG. 5, the disk tumbler lock 20 has a head portion 22 at one end thereof, through which a key slot 21 is provided for receiving an operation key (not shown) for locking and unlocking the disk tumbler lock 20. The disk tumbler lock 20 has an operation element 24 on the other end thereof opposite to the head portion 22. The element 24 is in the form of a flat column having two opposite major flat faces and two opposite curved faces, and rotates in cooperation with a plurality of disk tumblers 23, when the operation key is inserted into the key slot 21 and turned. The operation element 24 supports a lock pin 27 on each of the two opposite faces, with the bottom surface of the lock pin 27 in slidable contact with the face.

Figure 6:
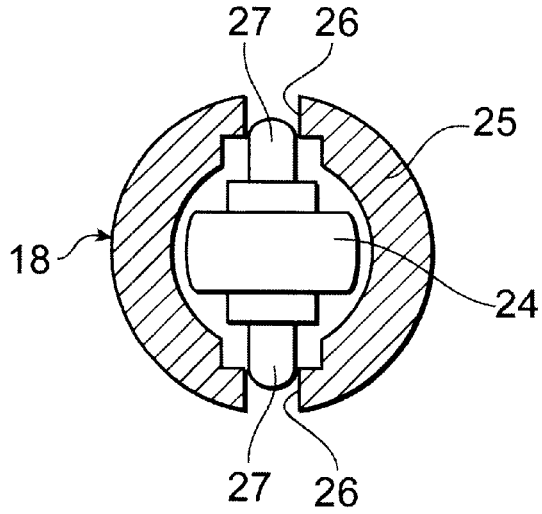
FIGS. 6(*a*) and 6(*b*) are explanatory views of the operation element of the disk tumbler lock of FIG. 5, showing the unlocked and locked positions.
Figure 6:
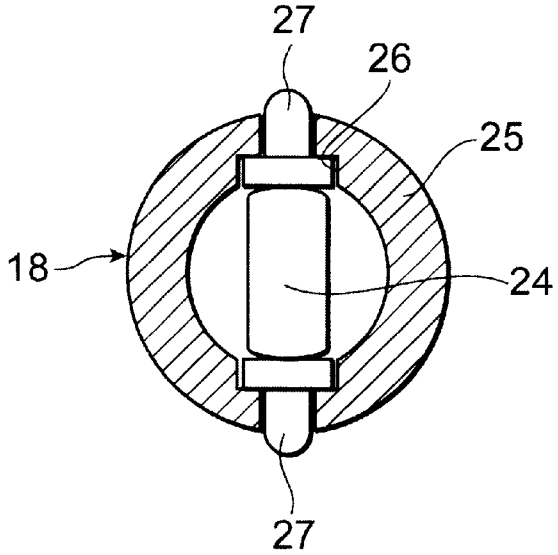

The disk tumbler lock 20 is cased in the cap cylinder 18 with the head portion 22 being exposed outside the cap cylinder 18 as shown in FIG. 4. Accordingly, the disk tumblers 23 are accommodated in the barrel 25 of the cap cylinder 18, and the operation element 24 is rotatably accommodated also in the barrel 25. In the portion of the barrel 25 facing to the operation element 24, a pair of pin holes 26 are provided diametrally opposite to each other as shown in FIGS. 6(*a*) and 6(*b*). Each of the pin holes 26 receives the lock pin 27 so that the pin 27 will not fall out.

When the operation element 24 is in the position as shown in FIG. 6(*a*), the lock pins 27 are supported on the flat major surfaces and in the retracted position with respect to the outer surface of the barrel 25, whereas when the operation element 24 is in the position as shown in FIG. 6(*b*), the lock pins 27 are supported on the curved faces and project with respect to the outer surface of the barrel 25 through the pin holes 26.

The locking device having the structure as discussed above functions for locking or unlocking a door and the like as follows. For locking a door by means of the locking means, the detachable handle 16 is inserted into the cavity of the cylindrical member 2 through the front open end to fit the engagement recess 17 of the handle 16 on the engagement boss 15 on the side of the locking means. With the recess 17 fitting on the boss 15, the grip 16*a* is turned to thereby turn the locking bar 12 into engagement with a catch and the like provided on the other door plate or the door casing (not shown). This completes locking of the door.

Next, the disk tumbler lock 20 cased in the cap cylinder 18, which is separate from the locking means and the cylindrical member 2, is unlocked by inserting the operation key into the key slot 21 and turning the key in the unlocking direction. Through this unlocking operation, the operation element 24 of the disk tumbler lock 20 rotates in the cap cylinder 18 into the position as shown in FIG. 6(*a*) and stops. In this state, each of the locking pins 27 is slidably supported on each of the major faces of the operation element 24, and arranged in a slightly retracted position with respect to the outer periphery of the cap cylinder 18.

With the locking pins 27 in the retracted position, the cap cylinder 18 is inserted into the cavity of the cylindrical member 2 with the locking pins 27 first. This insertion is guided by the guide ridges 19 on the cap cylinder 18 and the guide grooves 8 in the inner surface of the cylindrical member 2, with each of the ridges 19 being fitted in and slid along each of the grooves 8. The cap cylinder 18 is advanced into the cavity of the cylindrical member 2 until the head portion 22 of the disk tumbler lock 20 is seated in the annular step 6 of the cylindrical member 2. When the seating is properly completed, the disk tumbler lock 20 is set with the operation key.

This locking operation of the disk tumbler lock 20 rotates the operation element 24 in an operative direction into the erected state as shown in FIG. 6(*b*). This causes at least the tip of the lock pins 27 supported on the operation element 24 to protrude through the pin holes 26 with respect to the outer periphery of the cap cylinder 18 and to enter the annular groove 7 on the inner surface of the cylindrical member 2. When the lock pins 27 securely fit in the groove 7, the operation key is taken out of the key slot 21, and held in a safe place.

In this state, the cap cylinder 18 cannot be extracted from inside the cylindrical member 2 due to the engagement of the lock pins 27 in the annular groove 7. The cavity of the cylindrical member 2 is thus blocked with the cap cylinder 18, so that the detachable handle 16 cannot have access to the engagement boss 15 for operating the locking bar 12. This provides a double locking mechanism, functioning as an anti-theft lock.

In reverse, for unlocking the locking means as discussed above for opening the door, the operation key is inserted into the key slot 21 of the disk tumbler lock 20 that is cased in the cap cylinder 18 and retained in the cylindrical member 2, and turned in the unlocking direction. This operation causes the operation element 24 of the disk tumbler lock 20 to rotate in the same direction into the position as shown in FIG. 6(*a*), resulting in retraction of the lock pins 27 in contact with the operation element 24 through the pin holes 26.

The engagement between the pins 27 and the annular groove 7 is thus released, and the cap cylinder 18 with the disk tumbler lock 20 can be drawn out of the cylindrical member 2 by pulling the operation key with fingers. It is understood that the disk tumbler lock 20 is designed so that the operation key cannot be extracted from the key slot freely once the disk tumbler lock 20 is opened with the operation key.

As a result of the extraction of the cap cylinder 18 out of the cylindrical member 2, the blockage of the cavity of the cylindrical member 2 is cleared to expose the engagement boss 15 in the cavity of the cylindrical member 2. This enables insertion of the detachable handle 16 through the front open end of the cylindrical member 2 to fit the engagement recess 17 of the handle 16 on the engagement boss 15. Then, by turning the detachable handle 16, the engagement boss 15 is rotated, which turns the locking bar 12 screwed onto the shaft 11 in the unlocking direction to disengage from the corresponding catch provided on the other door plate or the door casing, to thereby unlock the door and enable opening of the door.

With such a double locking mechanism including the disk tumbler lock 20 and the locking means, a heavy, highly-loaded locking means, which is hard to operate directly with a key, may be operated with the detachable handle generating higher torque.

The detachable handle 16 may be provided with an engagement boss instead of the engagement recess 17, while the seal plate 13 of the locking assembly may be provided with an engagement recess instead of the engagement boss 15, to thereby realize similar locking and unlocking operation of the locking means through the engagement of the two parts. The cap cylinder 18 is provided separately from the cylindrical member 2 to which the locking means is mounted, and a single locking device may be structured simply by combining these two parts in a simple structure at low cost.

The seal ring 14 is provided between the inner surface of the cylindrical member 2 and the outer surface of the seal plate 13, and the seal 4 is fitted in the space between the rear surface of the flange portion 2*a* of the cylindrical member 2 and the front surface of the closure means 1. The two seals together securely prevent intrusion of water droplets or dust into the cavity of the cylindrical member 2 and to the connecting portion of the locking bar 12.

As discussed above, according to the present invention, the disk tumbler lock cased in the cap cylinder is detachably inserted into and accommodated in the cylindrical member, which lock may be secured to or released from inside the cylindrical member through setting or opening of the disk tumbler lock with the operation key. When the cap cylinder with the disk tumbler lock is opened and extracted from inside the cylindrical member, setting and opening of the locking means with the lock operation member are enabled, thereby providing ready locking and unlocking of a door and the like closure means with one hand while anti-theft security is improved with the double locking mechanism. Since the cap cylinder is provided as a separate part from the cylindrical member, and detachably placed inside the latter, the total assembly structure may be simplified and maintenance and inspection may be facilitated.

The cap cylinder may be extracted from the cylindrical member together with the key, so that the operability of the lock is improved, and the operation key is prevented from being lost. Further, the seal provided between the locking means and the cylindrical member prevents water droplets or dust from intruding through the cylindrical member into the area of the locking means, so that the operation trouble and corrosion of the locking means may be avoided.

By shaping the engagement member of the locking means as a boss or a recess that is fittable with a complementary recess or boss on the lock operation member, ready setting and opening of the locking means with the lock operation member are realized. Further, shaping the recess for receiving the lock pins as an annular groove advantageously facilitates fitting of the lock pins in the annular groove.

Although the present invention has been described with reference to the preferred embodiment, it should be understood that various modifications and variations can be easily made by those skilled in the art without departing from the spirit of the invention. Accordingly, the foregoing disclosure should be interpreted as illustrative only and is not to be interpreted in a limiting sense. The present invention is limited only by the scope of the following claims.

What is claimed is:

1. A locking device with a key-operated lock comprising:

a cylindrical member having a front open end and a rear end, locking means rotatably supported on said rear end of said cylindrical member, said locking means having a locking bar and a rotatable engagement member connected with respect to said locking bar, said engagement member being rotatable to turn said locking bar into a locking or an unlocking position, a key-operated disk tumbler lock, a cap cylinder casing said disk tumbler lock therein, said cap cylinder with said disk tumbler lock being detachably accommodated in said cylindrical member through the front open end, and a locking operation member provided independent from said cap cylinder for engaging with and rotating said engagement member to turn said locking bar into locking or unlocking position, wherein said cylindrical member has an engagement recess on its inner surface, said cap cylinder has a peripheral surface, and said disk tumbler lock has a lock pin capable of protruding through said peripheral surface and fitting in said engagement recess when said disk tumbler lock is set.

2. The locking device of claim 1 further comprising:

a key for setting or opening said disk tumbler lock.

3. The locking device of claim 2 wherein said key is unextractable from said disk tumbler lock when said disk tumbler lock is opened.

4. The locking device of claim 1 further comprising a seal disposed between said locking means and said inner surface of said cylindrical member.

5. The locking device of claim 1 wherein said engagement member is a boss or a recess.

6. The locking device of claim 1 wherein said engagement member is a boss and said locking operation member has a recess fitting with said boss, or said engagement member is a recess and said locking operation member has a boss fitting with said recess.

7. The locking device of claim 1 wherein said engagement recess on the inner surface of the cylindrical member is an annular groove formed circumferentially along the inner surface.

8. The locking device of claim 1 wherein said cylindrical member has a guide groove longitudinally extending on its inner surface, and said cap cylinder has a guide ridge longitudinally extending on its outer surface for fitting in said guide groove.

* * * * *